US006458048B1

(12) United States Patent
McGrath

(10) Patent No.: US 6,458,048 B1
(45) **Date of Patent: *Oct. 1, 2002**

(54) BASEBALL AND SOFTBALL PRACTICE DEVICE

(76) Inventor: Joseph M. McGrath, E. 1350 Hunters Ridge, Waupaca, WI (US) 54981

( * ) Notice: Subject to any disclaimer, the term of this patent is extended or adjusted under 35 U.S.C. 154(b) by 8 days.

This patent is subject to a terminal disclaimer.

(21) Appl. No.: 09/693,634

(22) Filed: Oct. 20, 2000

Related U.S. Application Data

(63) Continuation-in-part of application No. 09/097,982, filed on Jun. 16, 1998.

(51) Int. Cl.[7] ..... A63B 69/00; A63B 71/00; A63B 67/00

(52) U.S. Cl. ..... 473/421; 473/422; 473/435; 473/456; 273/410; 273/400; 273/354

(58) Field of Search ..... 473/421, 422, 473/454, 456, 462, 435, 478, 197, 195; 273/348, 354, 398, 400, 390, 402, 407, 410, DIG. 30

(56) References Cited

U.S. PATENT DOCUMENTS

| | | | | | |
|---|---|---|---|---|---|
| 392,565 | A | | 11/1888 | Larew | |
| 1,166,496 | A | * | 1/1916 | Torrey | 273/410 |
| 2,126,102 | A | * | 8/1938 | Fowler | 473/456 |
| 2,723,817 | A | * | 11/1955 | Harwood et al. | 248/464 |
| 2,819,903 | A | * | 1/1958 | Saunders | 273/410 |
| 2,922,653 | A | | 1/1960 | O'Brien | |
| 2,932,516 | A | | 4/1960 | Penner | |
| 3,001,795 | A | | 9/1961 | Johnson, Jr. | |
| 4,022,472 | A | * | 5/1977 | Seals | 273/400 |
| 4,036,465 | A | | 7/1977 | Kellner | |
| 4,092,023 | A | | 5/1978 | Hazen | |
| 4,097,044 | A | | 6/1978 | Miniere | |
| 4,160,549 | A | * | 7/1979 | Simpson | 473/462 |
| 4,188,031 | A | * | 2/1980 | Fox | 273/354 |
| 4,254,952 | A | * | 3/1981 | Playter, Jr. | 473/456 |
| 4,295,648 | A | | 10/1981 | Stromback | |
| 4,364,562 | A | | 12/1982 | White et al. | |
| 4,395,042 | A | | 7/1983 | Boswell | |
| 4,497,485 | A | | 2/1985 | Macosko | |
| 4,629,188 | A | | 12/1986 | Mahieu | |
| 4,643,423 | A | | 2/1987 | Wright | |
| 4,757,989 | A | * | 7/1988 | Bauer, Jr. | 482/83 |
| 4,872,674 | A | | 10/1989 | Deal | 473/435 |
| 4,955,607 | A | | 9/1990 | Maye | |
| 4,969,651 | A | | 11/1990 | Comartin | |
| 5,062,640 | A | * | 11/1991 | Haley | 273/DIG. 30 |
| 5,332,230 | A | | 7/1994 | Benedict | |
| D350,569 | S | | 9/1994 | Boteler | |
| 5,433,434 | A | | 7/1995 | Helmetsie | |
| 5,516,115 | A | * | 5/1996 | McLain | 273/354 |
| 5,738,599 | A | | 4/1998 | Malwitz | |
| 5,944,318 | A | * | 8/1999 | Payton | 273/402 |

* cited by examiner

*Primary Examiner*—Paul T. Sewell
*Assistant Examiner*—Mitra Aryanpour

(57) ABSTRACT

A ball throwing practice system for improving a ball player's skills that includes a collapsible support frame having a first pair of legs and a second pair of legs, with the second pair of legs being pivotally coupled to one of the first pair of legs to permit pivoting of the second pair of legs with respect to the first pair of legs. The system also includes a target assembly secured to the support frame for defining a passage therethrough for representing a zone for an accurately thrown ball to pass through. Preferably, the target assembly comprises a pair of substantially horizontally oriented plate members disposed in a spaced relationship, with a lower one of the plate members being located below an upper one of the plate members. The lower plate member may be suspended below the upper plate member by a plurality of cords. Each of the plate members may have a central aperture therethrough which is defined by an inner perimeter of each plate member, and an outer perimeter of each plate member may be substantially parallel to the inner perimeter.

15 Claims, 5 Drawing Sheets

BASEBALL AND SOFTBALL PRACTICE DEVICE

CROSS REFERENCE TO RELATED APPLICATION

This application is a continuation-in-part of application Ser. No. 09/097,982, filed Jun. 16, 1998.

BACKGROUND OF THE INVENTION

1. Field of The Invention

The present invention relates to baseball pitching targets and more particularly pertains to a new baseball and softball practice device for improving a ball player's skills in pitching, throwing, and hitting.

2. Description of the Prior Art

The use of baseball pitching targets is known in the prior art. More specifically, baseball pitching targets heretofore devised and utilized are known to consist basically of familiar, expected and obvious structural configurations, notwithstanding the myriad of designs encompassed by the crowded prior art which have been developed for the fulfillment of countless objectives and requirements.

Known prior art baseball pitching targets include U.S. Pat. No. 4,643,423 to Wright; U.S. Pat. No. 4,497,485 to Macosko; U.S. Pat. No. 4,955,607 to Maye; U.S. Pat. No. 4,295,648 to Stromback; U.S. Pat. No. 4,629,188 to Mahieu; and U.S. Des. Pat. No. 350,569 to Boteler.

While these devices fulfill their respective, particular objectives and requirements, the aforementioned patents do not disclose a new baseball and softball practice device. The inventive device includes a length of protective nylon netting. A support frame is provided that is comprised of a pair of opposed folding legs. The support fame includes a top panel and a pair of lower support panels. The support frame is positionable in front of the protective nylon netting. A target is secured between the pair of opposed folding legs of the support frame.

In these respects, the baseball and softball practice device according to the present invention substantially departs from the conventional concepts and designs of the prior art, and in so doing provides an apparatus primarily developed for the purpose of improving a ball player's skills in pitching, throwing, and hitting.

SUMMARY OF THE INVENTION

In view of the foregoing disadvantages inherent in the known types of baseball pitching targets now present in the prior art, the present invention provides a new baseball and softball practice device construction wherein the same can be utilized for improving a ball player's skills in pitching, throwing, and hitting.

The general purpose of the present invention, which will be described subsequently in greater detail, is to provide a new baseball and softball practice device apparatus and method which has many of the advantages of the baseball pitching targets mentioned heretofore and many novel features that result in a new baseball and softball practice device which is not anticipated, rendered obvious, suggested, or even implied by any of the prior art baseball pitching targets, either alone or in any combination thereof.

To attain this, the present invention generally comprises a collapsible support frame having a first pair of legs and a second pair of legs, with the second pair of legs being pivotally coupled to one of the first pair of legs to permit pivoting of the second pair of legs with respect to the first pair of legs. The system also includes a target assembly secured to the support frame for defining a passage therethrough for representing a zone for an accurately thrown ball to pass through. Preferably, the target assembly comprises a pair of substantially horizontally oriented plate members disposed in a spaced relationship, with a lower one of the plate members being located below an upper one of the plate members. The lower plate member may be suspended below the upper plate member by a plurality of cords. Each of the plate members may have a central aperture therethrough which is defined by an inner perimeter of each plate member, and an outer perimeter of each plate member may be substantially parallel to the inner perimeter.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new baseball and softball practice device apparatus and method which has many of the advantages of the baseball pitching targets mentioned heretofore and many novel features that result in a new baseball and softball practice device which is not anticipated, rendered obvious, suggested, or even implied by any of the prior art baseball pitching targets, either alone or in any combination thereof.

It is another object of the present invention to provide a new baseball and softball practice device which may be easily and efficiently manufactured and marketed.

It is a further object of the present invention to provide a new baseball and softball practice device which is of a durable and reliable construction.

An even further object of the present invention is to provide a new baseball and softball practice device which is susceptible of a low cost of manufacture with regard to both materials and labor, and which accordingly is then susceptible of low prices of sale to the consuming public, thereby making such baseball and softball practice device economically available to the buying public.

Still yet another object of the present invention is to provide a new baseball and softball practice device which provides in the apparatuses and methods of the prior art some of the advantages thereof, while simultaneously overcoming some of the disadvantages normally associated therewith.

Still another object of the present invention is to provide a new baseball and softball practice device for improving a ball player's skills in pitching, throwing, and hitting.

Yet another object of the present invention is to provide a new baseball and softball practice device which includes a length of protective nylon netting. A support frame is provided that is comprised of a pair of opposed folding legs. The support fame includes a top panel and a pair of lower support panels. The support frame is positionable in front of the protective nylon netting. A target is secured between the pair of opposed folding legs of the support frame.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
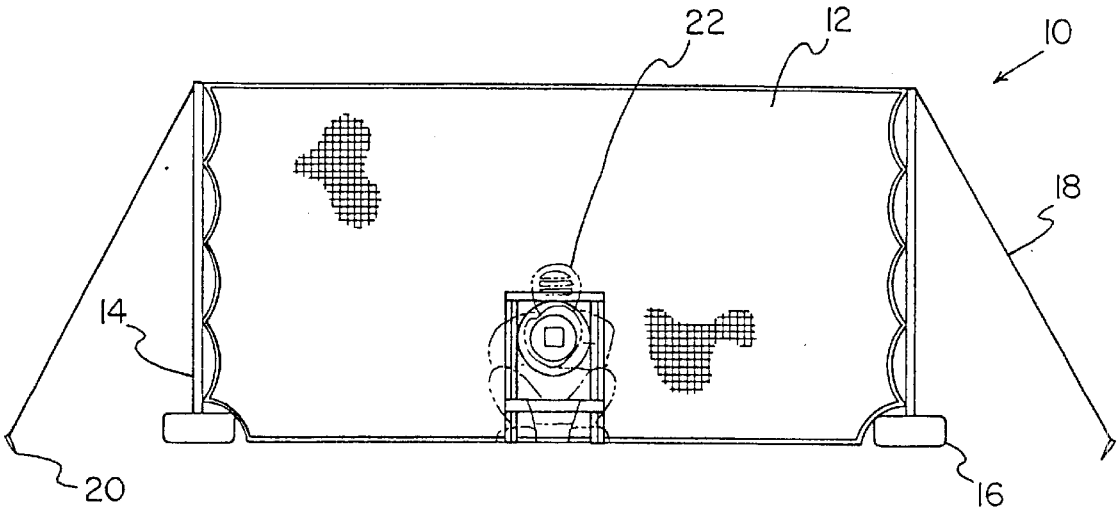
FIG. 1 is a front view of a new baseball and softball practice device according to the present invention.
Figure 2:
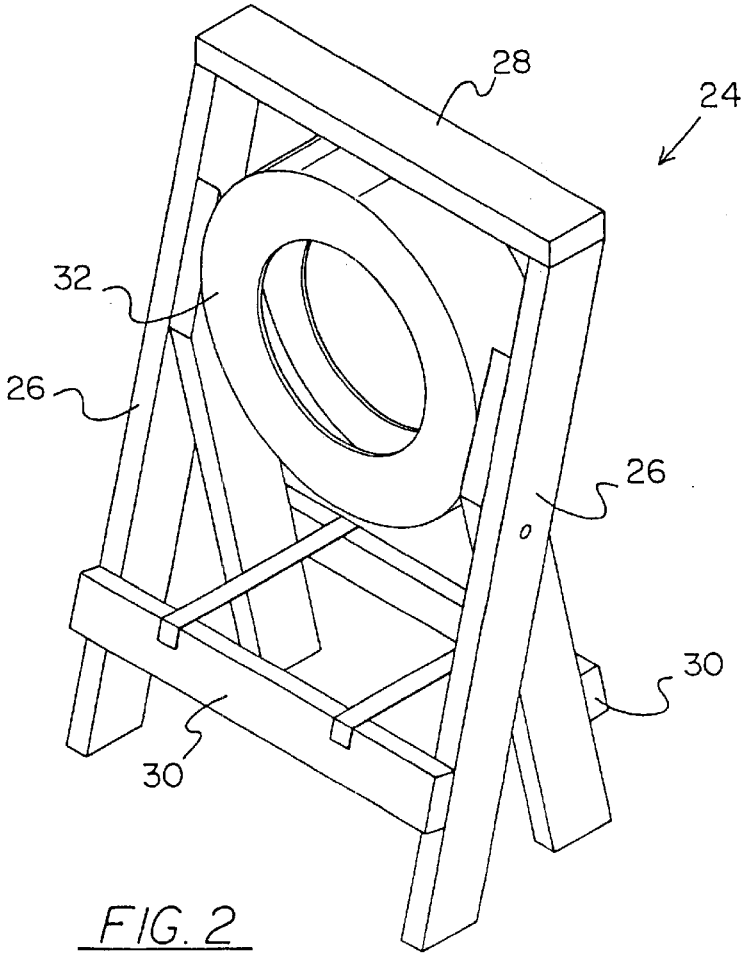
FIG. 2 is a perspective view of the tire target and support frame of the present invention.
Figure 3:
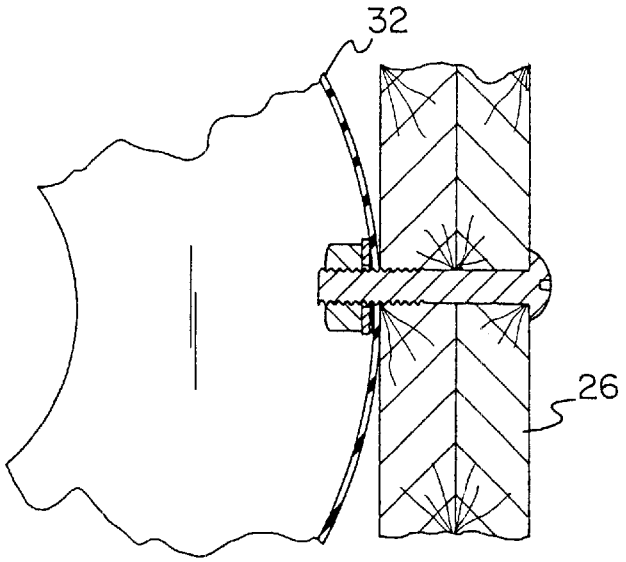
FIG. 3 is a cross-sectional view of the present invention illustrating the securement of the tire target to the support frame.
Figure 4:
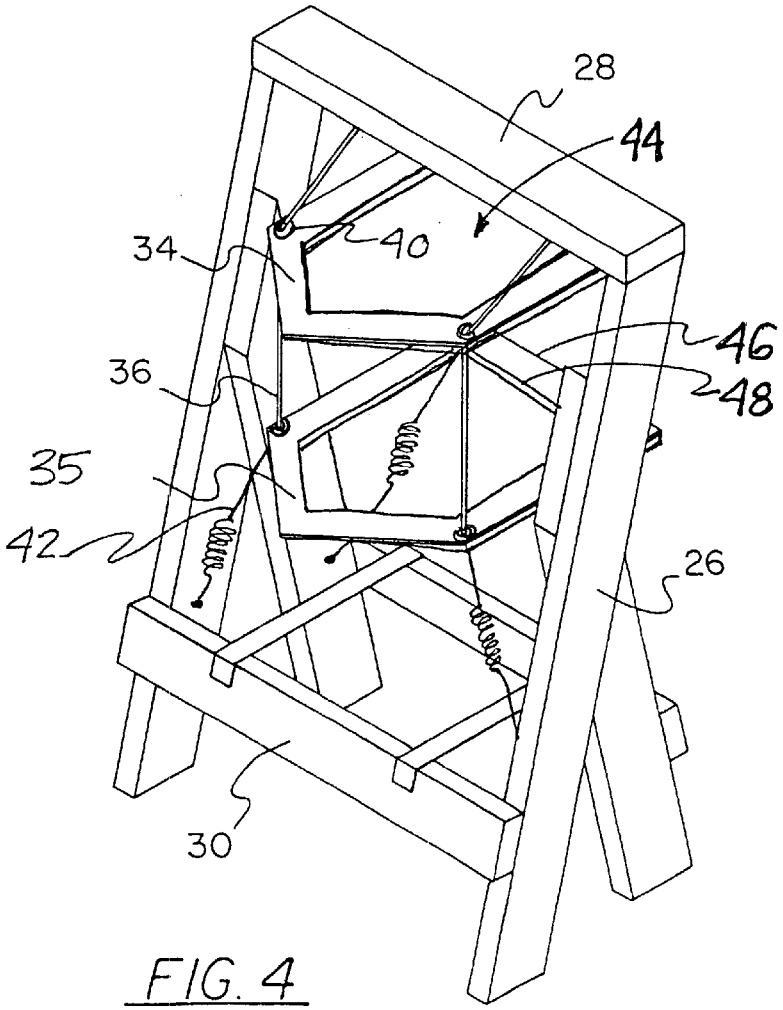
FIG. 4 is a perspective view of the present invention illustrating an optional target assembly shown secured to the support frame.
Figure 5:
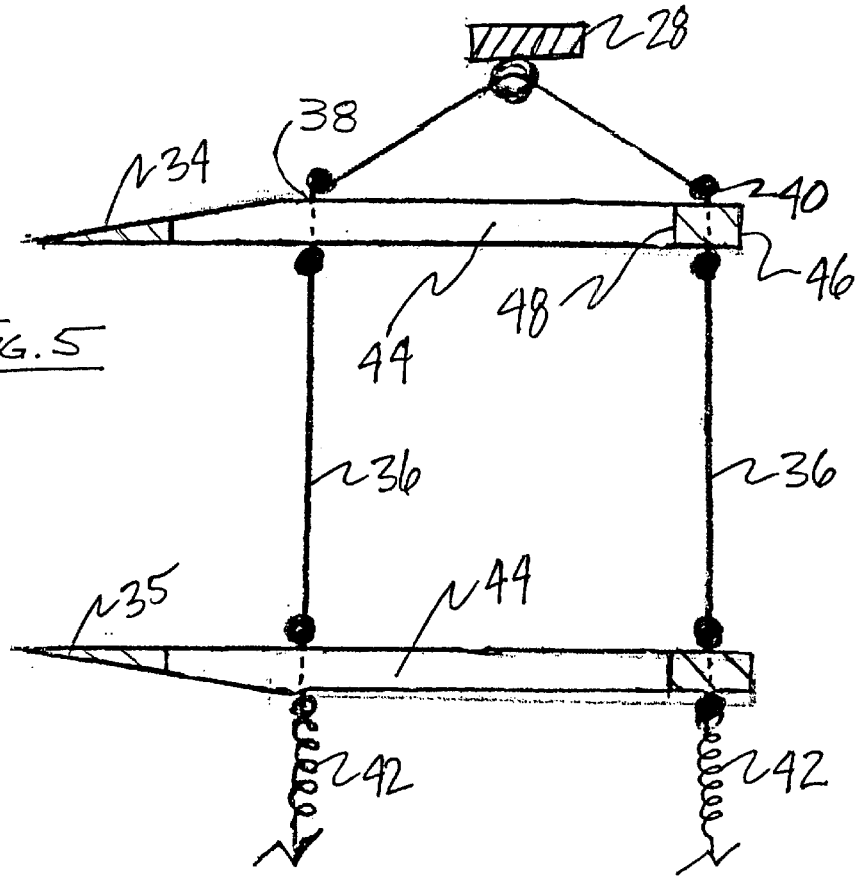
FIG. 5 is a partial sectional view of the target assembly and support frame of FIG. 4.
Figure 6:
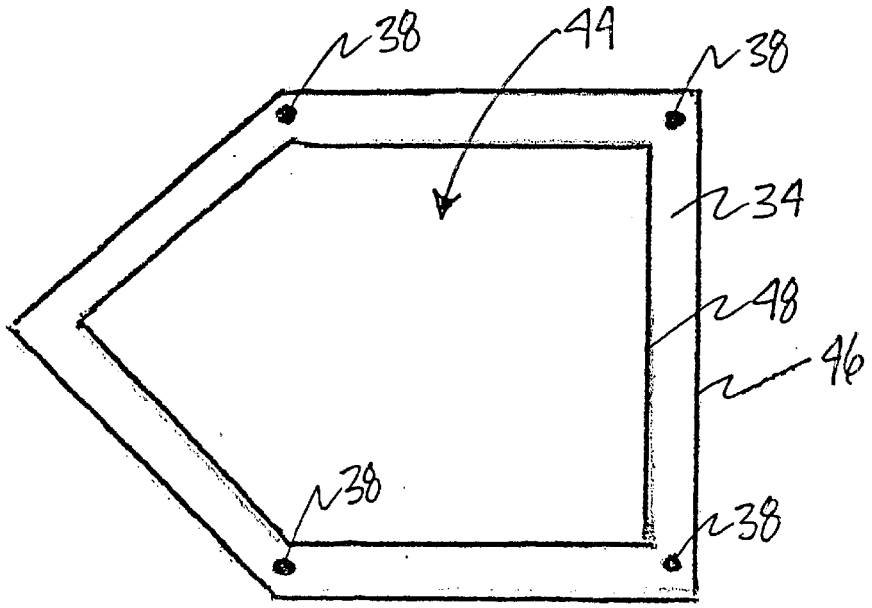
FIG. 6 is a top view of the top plate of the target assembly of FIG. 4.
Figure 7:
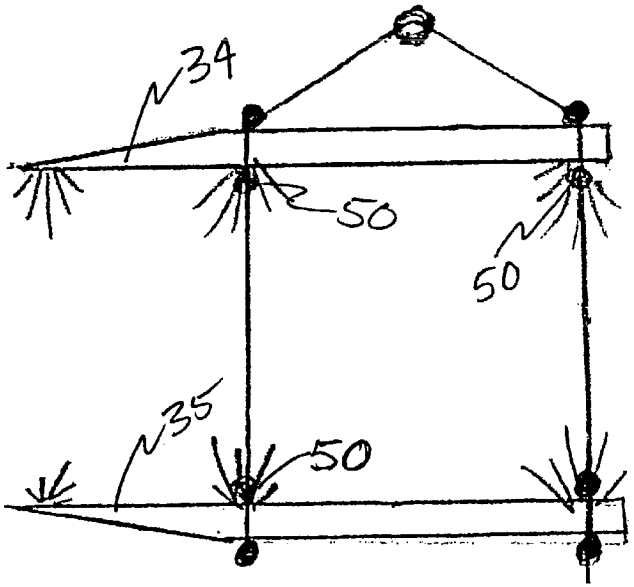
FIG. 7 is a side view of the target assembly showing the location of optional sensors.
Figure 8:
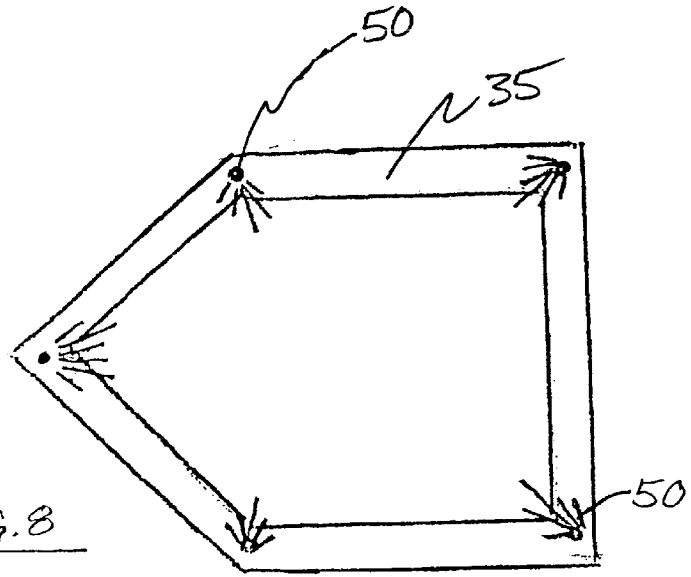
FIG. 8 is a top view of the target assembly of FIG. 7.
Figure 9:
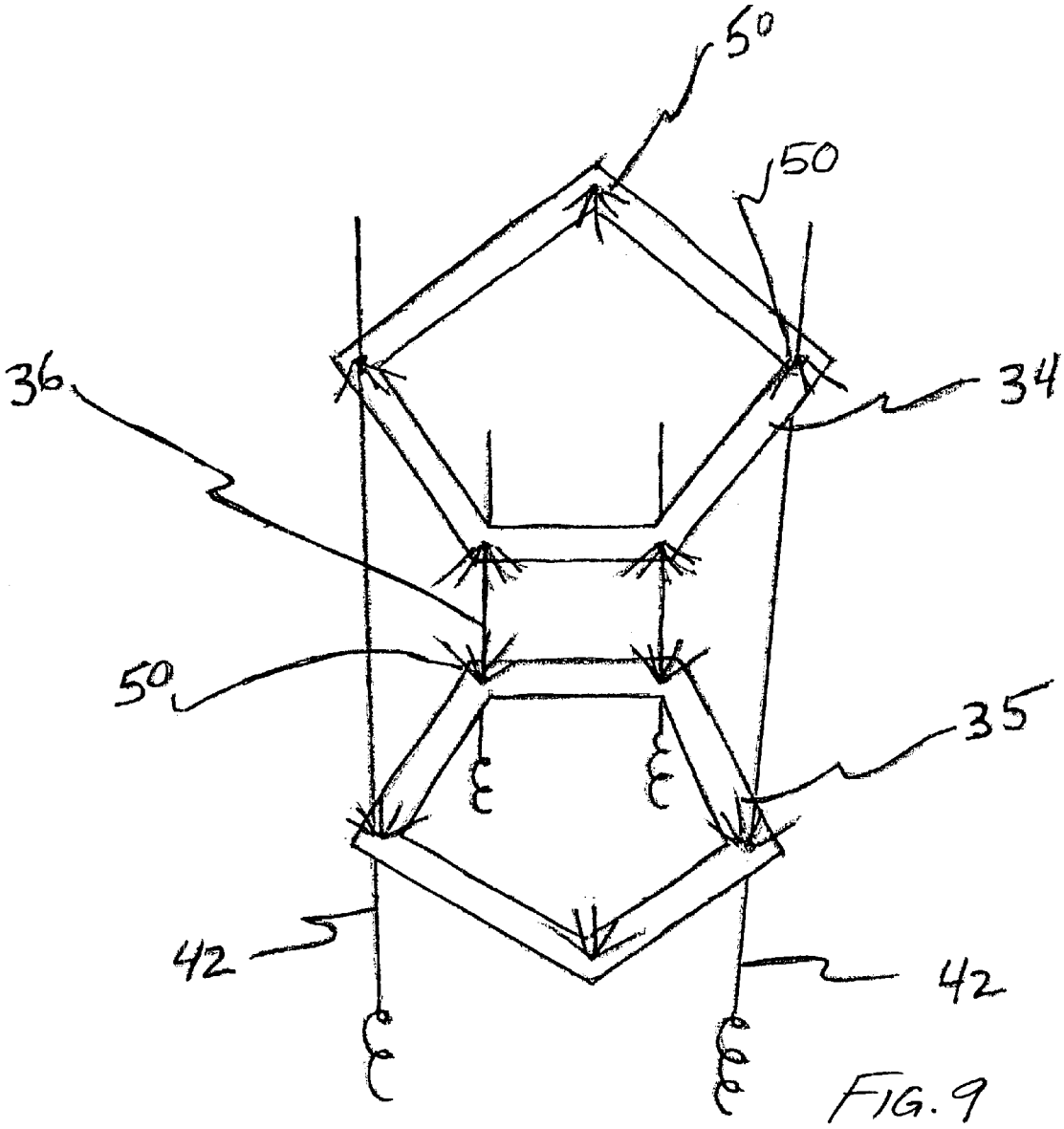
FIG. 9 is a front view of the target assembly .

With reference now to the drawings, and in particular to FIGS. 1 through 9 thereof, a new baseball and softball practice device embodying the principles and concepts of the present invention and generally designated by the reference numeral 10 will be described.

As best illustrated in FIGS. 1 through 4, the baseball and softball practice device 10 comprises a ball stopping assembly including a length of protective nylon netting 12, a support frame 24, and a target assembly.

The netting 12 of the ball stopping assembly has opposite ends that are secured to elongated poles 14. The elongated poles 14 each have a weighted base 16 secured to free lower ends thereof. Free upper ends of the poles 14 each have a tie down line 18 extending outwardly therefrom. The tie down lines 18 each have stakes 20 disposed on free ends for penetrating a ground surface. The weighted bases 16 and the tie down lines 18 serve to stabilize the netting 12. Optionally, the netting 12 may have a picture of a catcher 22 thereon to contribute to the realism of the present invention.

The support frame 24 may be positioned in front of the netting 12. Preferably, the support frame 24 can be collapsed for easy storage. The support frame 24 has a first pair of legs and a second pair of legs (see FIG. 2). The first pair of legs are laterally spaced and substantially rigidly connected by a top panel 28 and a first lower panel 30. The top panel is mounted to upper ends of the first pair of legs 26. The first lower panel is mounted to the first pair of legs at a location spaced from lower ends of the first pair of legs. The second pair of legs is laterally spaced and substantially rigidly connected by a second lower panel. The second lower panel is mounted to the second pair of legs at a location spaced upwardly from lower ends of the second pair of legs. The second pair of legs each have an upper end, and each of the upper ends of the second pair of legs is pivotally coupled to one of the first pair of legs to permit pivoting of the second pair of legs with respect to the first pair of legs. The second pair of legs is positioned between the first pair of legs so that the second pair of legs may be pivoted into a nested position between the first pair of legs for permitting a more compact storage configuration. The support frame may include a pair of straps extending between the first and second lower panels to limit the pivot movement of the second pair of legs with respect to the first pair of legs.

The target assembly is provided for defining a passage therethrough for representing a zone for an accurately thrown ball to pass through in order to gauge a player's ability to accurately throw or pitch the ball. One preferred target assembly (see FIG. 2) comprises a circular tire 32.

Another preferred target assembly (see FIG. 4) comprises a pair of substantially horizontally oriented plate members 34, 35 disposed in a spaced relationship. An lower one 35 of the plate members is located below an upper one 34 of the plate members. The pair of plate members 34, 35 are secured to the support frame 24. Preferably, an outer perimeter of the upper 34 and lower 35 plates has a shape that approximates a baseball or softball home plate and resembles a square with a triangle attached to one edge of the square.

The target assembly also may include a plurality of cords 36 which suspend the plate members from the support frame, and more specifically suspends the upper plate member from the top panel, and the lower plate member below the upper plate member. Preferably, each of the plate members has a plurality of holes 38 therethrough, and each of the cords passes through one of the holes in each of the plate members. The holes most preferably are located toward the corners of the plate members so as not to intrude into the target zone.

A slider 40 may be frictionally mounted on each of the cords such that the slider may be positioned against one of the plate members adjacent one of the holes for holding the plate member in a selected position. on the cord. Illustratively, the frictional relationship may be created by a hole formed in the slider that is slightly smaller than the size of the outer surface of the cord, so that a pinching interference fit is created between the hole in the slider and the cord that permits only forceful slipping of the slider on the cord. Optionally, a slider may be positioned adjacent to each surface of the plate member for resisting upward and downward movement of the plate member. The position of the sliders may be adjusted to permit movement of the plate members into orientations substantially parallel to the legs of the support frame.

Optionally, a biasing spring 42 may be extended between a lower end of each cord and a lower location on an adjacent leg of the support frame for applying tension to the cords. Preferably, each of the cords has a biasing spring extending from its lower end to the adjacent leg. The biasing springs may be removed or disconnected if required when the support frame is folded into a collapsed, storage position.

Preferably, each of the plate members has a central aperture 44 extending through the plate member. The upper and lower plate members each have an outer perimeter 46 and an inner perimeter 48, with the inner perimeter of each plate member defining the central aperture in the plate member. Most preferably, the inner perimeter of each plate member extends substantially parallel to the outer perimeter so that a perimeter frame is formed about the central aperture.

As a further option, a plurality of sensors 50 may be mounted on the plate members 34, 35 at spaced positions for detecting the passage of a ball between the upper and lower plate members. Preferably, sensors are mounted on the lower surface of the upper plate member and the upper surface of the lower plate member and are directed toward the zone. The sensors may be mounted at corners of the upper and lower plate members.

The invention creates a zone that allows players, such as baseball or softball players, to practice and improve their pitching and throwing through a target zone, which may be configured to resemble a strike zone. The thrown ball may pass between the plate members and between the rear pair or side pair of cords.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ball throwing practice system for improving a ball player's skills comprising:

a collapsible support frame having a first pair of legs and a second pair of legs, the second pair of legs each having an upper end, each of second pair of legs having an upper end pivotally coupled to one of the first pair of legs to permit pivoting of the second pair of legs with respect to the first pair of legs; and a target assembly secured to the support frame, the target assembly defining a passage therethrough for representing a zone for an accurately thrown ball to pass through;

wherein the target assembly comprises a pair of substantially horizontally oriented plate members disposed in a spaced relationship, a lower one of the plate members being located below an upper one of the plate members;

wherein each of the plate members has a central aperture therethrough.

2. The system of claim 1 additionally comprising a plurality of cords suspending the lower plate member below the upper plate member.

3. The system of claim 2 wherein each of the plate members has a plurality of holes therethrough, and each of the cords passes through one of the holes in the plate members.

4. The system of claim 3 wherein a biasing spring is extended between a lower end of one of the cords and one of the legs of the support frame for applying tension to the cord.

5. The system of claim 3 wherein a slider is frictionally mounted on each of the cords such that the slider may be positioned against one of the plate members adjacent one of the holes for holding the plate member in a selected position on the cord.

6. The system of claim 1 wherein the upper and lower plate members each have an outer perimeter and an inner perimeter, the inner perimeter of each plate member defining the central aperture in the plate member, the inner perimeter of each plate member being substantially parallel to the outer perimeter.

7. The system of claim 1 additionally comprising a ball stopping assembly for positioning behind the target assembly, the ball stopping assembly comprising a length of netting, a pair of elongated poles, the netting having opposite ends secured to the elongated poles.

8. The system of claim 7 wherein each of the elongated poles has a weighted base secured to lower ends of the poles, and a tie down line is extendable from each of the poles at a free upper end of the pole, each of the tie down lines having a stake disposed on a free end thereof for penetrating a ground surface.

9. The system of claim 1 wherein the first pair of legs are laterally spaced and substantially rigidly connected by a top panel and a first lower panel.

10. The system of claim 9 wherein the top panel is mounted to upper ends of the first pair of legs, the first lower panel being mounted to the first pair of legs at a location spaced from lower ends of the first pair of legs.

11. The system of claim 1 wherein the second pair of legs is laterally spaced and substantially rigidly connected by a second lower panel, the second lower panel being mounted to the second pair of legs at a location spaced upwardly from lower ends of the second pair of legs.

12. The system of claim 11 wherein the second pair of legs is positioned between the first pair of legs so that the second pair of legs may be pivoted into a nested position between the first pair of legs for permitting a more compact storage configuration.

13. The system of claim 1 wherein the support frame includes a first lower panel connecting the first pair of legs and a second lower panel connecting the second pair of legs, and a strap extending between the first and second lower panels to limit the pivot movement of the second pair of legs with respect to the first pair of legs.

14. The system of claim 1 wherein the target is mounted in a manner permitting pivotally of the target with respect to the first and second pair of legs.

15. A ball throwing practice system for improving a ball player's skills comprising:

a collapsible support frame having a first pair of legs and a second pair of legs, lower ends of the first and second pairs of legs defining a ground plane when rested on a ground surface, the second pair of legs each having an upper end, each of second pair of legs having an upper end pivotally coupled to one of the first pair of legs to permit pivoting of the second pair of legs with respect to the first of legs; and a target assembly secured to the support frame, the target assembly defining a passage therethough for representing a zone for an accurately thrown ball to pass through, the target assembly including a pair of plate members disposed in a spaced relationship, a lower one of the plate members being located below an upper one of the plate members;

wherein the support frame supports the upper and lower plates of the target assembly in an orientation substantially parallel to the ground plane defined by the pair of legs for positioning the upper and lower plates in a substantially parallel orientation to the ground surface.

* * * * *